US006030246A

United States Patent [19]

Kunishi

[11] Patent Number: 6,030,246

[45] Date of Patent: Feb. 29, 2000

[54] ELECTRICAL CONNECTOR FOR FLAT CIRCUITRY

[75] Inventor: Shinsuke Kunishi, Hadano, Japan

[73] Assignee: Molex Incorporated, Lisle, Ill.

[21] Appl. No.: 09/144,155

[22] Filed: Aug. 31, 1998

[30] Foreign Application Priority Data

Sep. 5, 1997 [JP] Japan ..... 9-257472

[51] Int. Cl.[7] ..... H01R 13/62

[52] U.S. Cl. ..... 439/329; 439/495

[58] Field of Search ..... 439/329, 67, 77, 439/493, 497, 498, 499, 494, 495, 492, 607, 609, 496, 296

[56] References Cited

U.S. PATENT DOCUMENTS

| | | | |
|---|---|---|---|
| 4,023,877 | 5/1977 | Hennessey et al. | 339/17 F |
| 4,235,500 | 11/1980 | Belopavlovich et al. | 339/176 MF |
| 4,416,497 | 11/1983 | Brandsness et al. | 339/17 F |
| 4,509,811 | 4/1985 | Amano et al. | 339/17 F |
| 4,639,063 | 1/1987 | Mueller | 339/75 M |
| 4,640,562 | 2/1987 | Shoemaker | 439/77 |
| 4,824,391 | 4/1989 | Ii | 439/329 |
| 4,975,080 | 12/1990 | Daly et al. | 439/498 |
| 5,007,856 | 4/1991 | Puerner | 439/452 |
| 5,061,205 | 10/1991 | Toramoto | 439/493 |
| 5,871,369 | 2/1999 | Obayashi et al. | 439/495 |
| 5,893,775 | 4/1999 | Annokkee et al. | 439/495 |
| 5,911,597 | 6/1999 | Oshitani | 439/495 |
| 5,944,554 | 8/1999 | Armand et al. | 439/499 |

*Primary Examiner*—Paula Bradley
*Assistant Examiner*—Ross N. Gushi
*Attorney, Agent, or Firm*—Stephen Z. Weiss

[57] ABSTRACT

An electrical connector is provided for receiving a flat electrical circuit. The connector includes an elongated housing defining a slot for receiving the flat electrical circuit. A plurality of terminals are mounted on the housing, with resilient contact portions spaced along the slot. An elongated support member is mounted on the housing for providing reinforcing support therefor. The support member is positioned for backing the resilient contact portions of the terminals to perform a dual function of providing reinforcing support behind the resilient contact portions.

17 Claims, 5 Drawing Sheets

ELECTRICAL CONNECTOR FOR FLAT CIRCUITRY

FIELD OF THE INVENTION

This invention generally relates to the art of electrical connectors and, particularly, to an electrical connector for terminating a flat circuit, such as the end of a flat flexible circuit.

BACKGROUND OF THE INVENTION

In general, an electrical connector typically includes a dielectric housing (e.g. plastic) which mounts a plurality of conductive terminals having contact portions for making electrical connection with the terminals of a complementary mating connector, with electrical wires or cables or with a variety of other electrical devices. Some electrical connectors are elongated and include slots for receiving flat electrical circuits, such as the distal ends of flat flexible circuits having exposed, generally parallel conductors.

One of the continuing problems with elongated electrical connectors which receive flat circuits is the problem of the connector housing bowing because of the interacting forces between the circuit and the resilient contact portions of the terminals spaced along the elongated circuit-receiving slot. Because of an ever-increasing demand for reducing the thickness or size of such flat circuit connectors, there is a tendency to reduce the thickness of the walls which define one or both sides of the circuit-receiving slot. Elongating the connector or reducing the thickness of the walls leads to an undesirable reduction in the strength of the walls, because the housing typically is fabricated as a unitary structure of plastic material.

Another problem with such connectors for flat circuits involves the terminals themselves. Not only does the trend of ever-increasing miniaturization of such connectors cause the terminals to be extremely delicate or fragile, but the ever-increasing density in circuits within a given size limitation results in the terminals being extremely small. The resilient contact portions of the terminals may have insufficient contact forces and may be prone to breakage or at least losing their resiliency.

The present invention solves these problems by providing a unique elongated support member which not only provides reinforcing support for the connector housing but also provides reinforcing support for the resilient contact portions of the terminals.

SUMMARY OF THE INVENTION

An object, therefore, of the invention is to provide a new and improved electrical connector for receiving a flat electrical circuit.

In the exemplary embodiment of the invention, the connector includes an elongated housing means defining a slot for receiving the flat electrical circuit. A plurality of terminals are mounted on the housing means, with resilient contact portions spaced along the slot. An elongated support member is mounted in the housing means for providing reinforcing support therefore. The support member is positioned for backing the resilient contact portions of the terminals to perform a dual function of providing reinforcing support behind the resilient contact portions.

As disclosed herein, the housing means includes a dielectric base forming one side of the circuit-receiving slot. A metal cover forms an opposite side of the slot. The support member is mounted in the base. The support member is fabricated of metal material having a dielectric coating at least in areas of engagement with the contact portions of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 2:
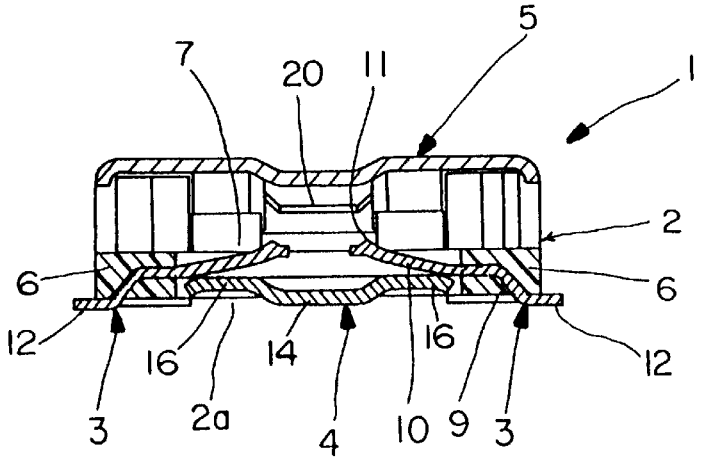
FIG. 2 is a vertical section taken generally along line 2—2 of FIG. 1.

Referring to the drawings in greater detail, FIGS. 1–10 show a first embodiment of an electrical connector, generally designated 10, for receiving a flat electrical circuit, such as the end of a flat flexible circuit. The connector includes a housing means defined by a dielectric base, generally designated 2, mounting a plurality of terminals, generally designated 3. The connector and base are elongated, and a support member, generally designated 4, is mounted in the dielectric base for providing reinforcing support therefor. A metal cover, generally designated 5, is mounted on top of the base.

Figure 4:
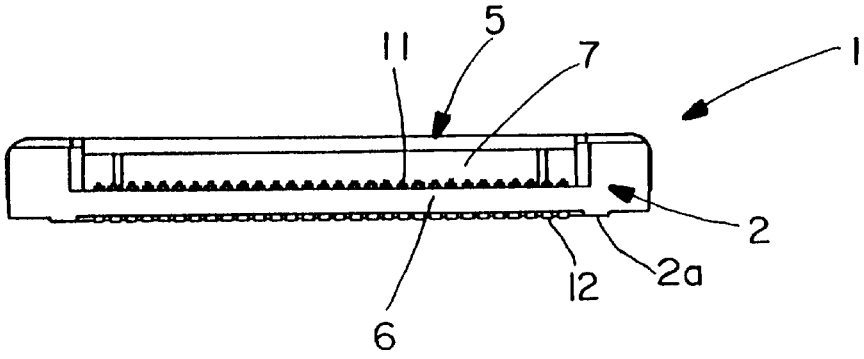
FIG. 4 is a side elevational view of the connector of FIG. 1.
Figure 5:
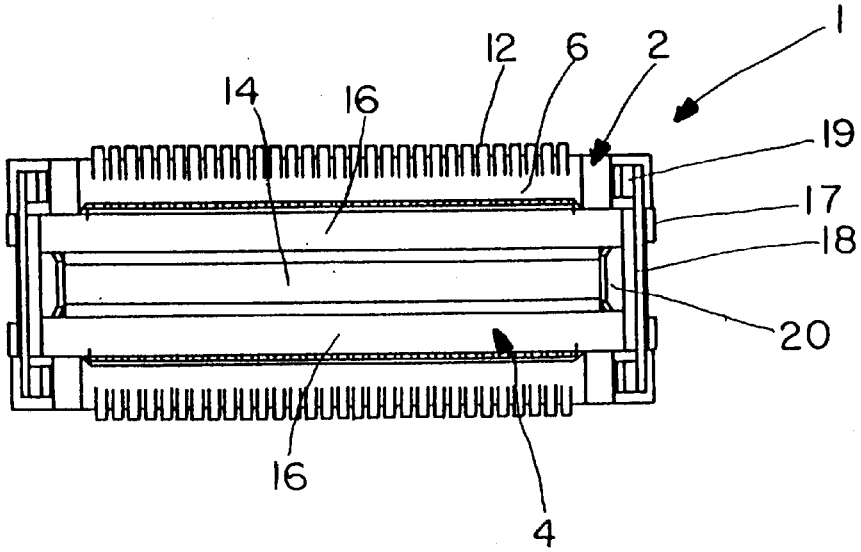
FIG. 5 is a bottom plan view of the connector of FIG. 1.
Figure 6:
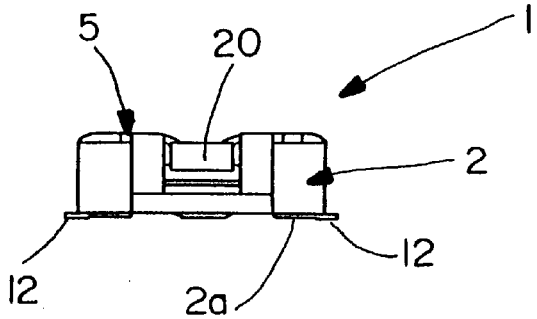
FIG. 6 is an end elevational view of the connector of FIG. 1.

Base 2 is unitarily molded of dielectric material such as plastic or the like in a frame configuration generally rectangular in a plan view. Terminals 3 are insert-molded in the base as best seen in FIG. 2. The terminals are insert-molded within terminal-mounting portions 6 which run lengthwise of the connector. A circuit-receiving slot 7 (FIGS. 2 and 4)

is defined between mounting portions 6 of the base and cover 5. Four rectangular apertures 8 are formed in the four corners of the generally rectangular base for mounting support member 4, as described hereinafter.

Figure 1:
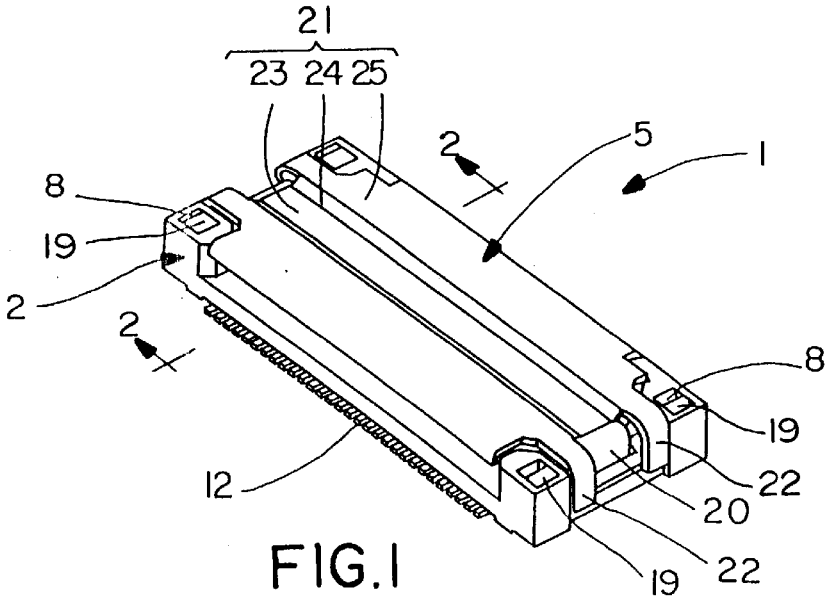
FIG. 1 is a perspective view of a first embodiment of an electrical connector according to the invention.
Figure 3:
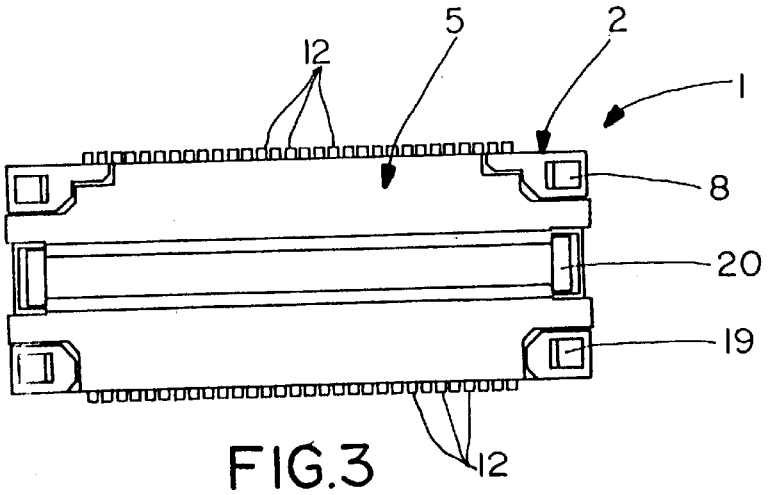
FIG. 3 is a top plan view of the connector of FIG. 1.

As best seen in FIG. 2, there are two rows of terminals extending along opposite sides of the connector. Each terminal includes a body portion 9 insert-molded and, thereby, fixed within one of the mounting portions 6 of the dielectric base. A resilient contact portion 10 is angled upwardly of the body portion and projects into circuit-receiving slot and terminates in a contact point or distal end 11. Tail portions 12 of the terminals extend from the opposite end of body portion 9, exteriorly of the dielectric base, to form two rows of tail portions 12 as best seen in FIGS. 1–3. All of the tail portions are coplanar and generally flush with a bottom surface 2*a* of the dielectric base for surface mounting to appropriate circuit traces on a printed circuit board (not shown), as by soldering.

Figure 7:
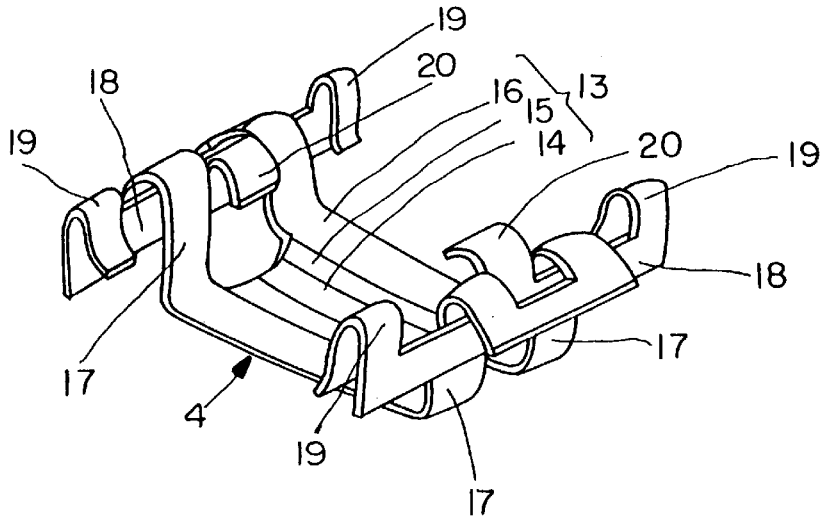
FIG. 7 is a perspective view of the support member for the embodiment of FIG. 1.

Support member 4 is stamped and formed of sheet metal material into a configuration shown in FIG. 7. The support member includes a main body 13 having substantially the same length as dielectric base 2 of the connector housing means. Main body 13 includes a pair of elongated side biasing portions 16 joined to a fixing portion 14 by inclined wall portions 15. A generally inverted U-shaped locking portion 17 is formed at each opposite end of main body 13 and joined to biasing portions 16. Each locking portion includes a transverse bar 18 having inverted U-shaped locking tabs 19 at opposite ends thereof. An inwardly directed hook 20 projects inwardly of transverse bar 18 generally centrally thereof and aligned with fixing portion 14 of main body 13.

In assembly, locking tabs 19 of support member 4 are press-fit into apertures 8 formed in the four corners of dielectric base 2 of the connector housing means. The locking tabs are inserted into the apertures from bottom surface 2*a* of the base. Main body 13 of the support member is disposed between terminal mounting portions 6 of the dielectric base as seen best in FIGS. 2 and 5. Fixing portion 14 becomes coplanar or flush with bottom surface 2*a* of the base and tail portions 12 of the terminals, whereby the fixing portion of the support member can be fixed, as by soldering, to an appropriate support pad on the printed circuit board. Biasing portions 16 of the support member become engaged beneath resilient contact portions 10 of the terminals as best seen in FIG. 2. At least the biasing portions of the support member are coated with a dielectric coating to prevent shorting of the terminals. Therefore, it can be seen that support member 4 performs a dual function of providing reinforcing support for the dielectric base of the connector housing means as well as providing reinforcing support behind the resilient contact portions of the terminals.

Cover 5 can be stamped and formed of sheet metal material and formed into a configuration adapted to cover the top of circuit-receiving slot 7 as seen in FIGS. 1–3. The cover includes a main body 21 having a pair of locking portions 22 at each opposite end thereof. Each locking portion 22 is adapted to releasably mount the cover to locking portions 17 of support member 4. Main body 21 of the cover is formed to include two elongated side portions 25 connected to an elongated central portion 23 by inclined wall portions 24. Central portion 23 of the cover provides a flat surface for a vacuum-type pick-and-place assembly and transport apparatus.

Figure 8:
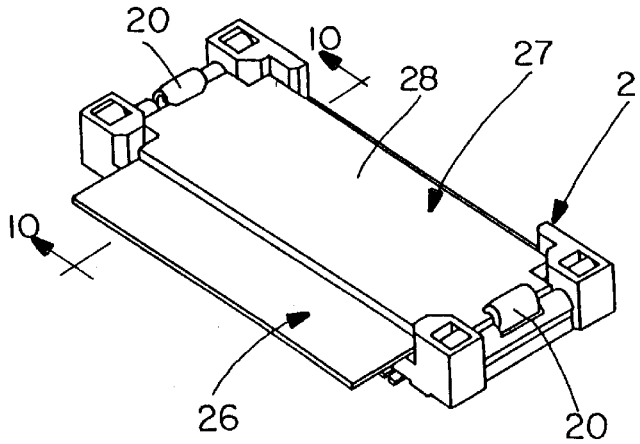
FIG. 8 is a perspective view of the connector of FIG. 1, with a flat circuit received therein and with the metal cover removed.
Figure 9:
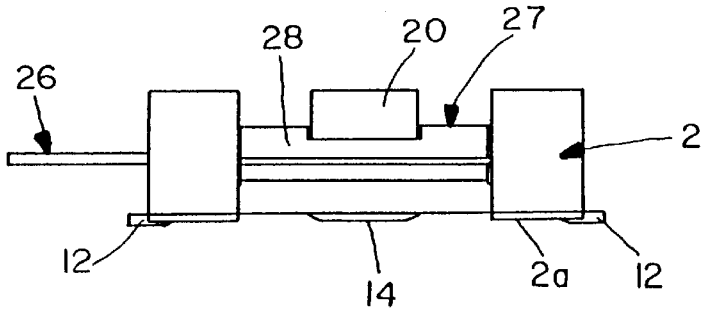
FIG. 9 is an end elevational view of the assembly of FIG. 8.
Figure 10:
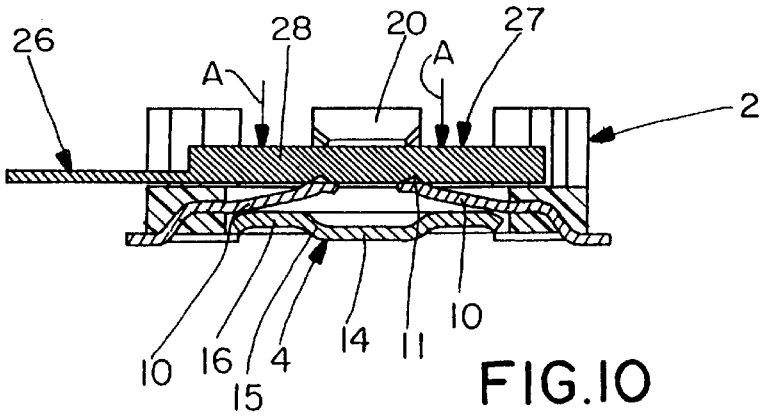
FIG. 10 is an enlarged vertical section taken generally along line 10—10 of FIG. 8.

A flat circuit 26 is terminated within connector 1 by removing cover 5 as shown in FIGS. 8-10 exposing slot 7 on the upper side of dielectric base 2 of the connector housing means. A thickened end portion 27 of the flat circuit includes conductive portions on the bottom side thereof for engaging contact points 11 of resilient contact portions 10 of the terminals. The thickened end 27 of the flat circuit may be provided by a back plate 28 which rigidifies the circuit. Therefore, the end of the circuit, including the back plate, is assembled by pushing down on the circuit and back plate in the direction of arrows "A" (FIG. 10) until the circuit and back plate snap beneath hooks 20 of support member 4. In this mated condition, end portion 27 of circuit 26 and back plate 28 are clamped between resilient contact portions 10 of the terminals and hooks 20 of the support member in a highly reliable electrical connection as the support member provides reinforcing support behind the resilient contact portions of the terminals.

Figure 11:
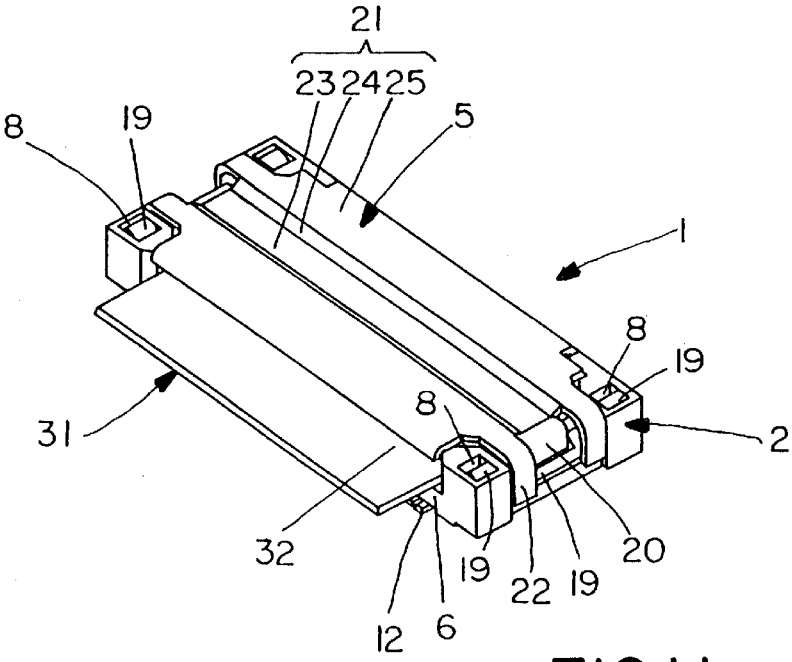
FIG. 11 is a perspective view of a second embodiment of an electrical connector according to the invention, with the cover partially assembled to the base.
Figure 12:
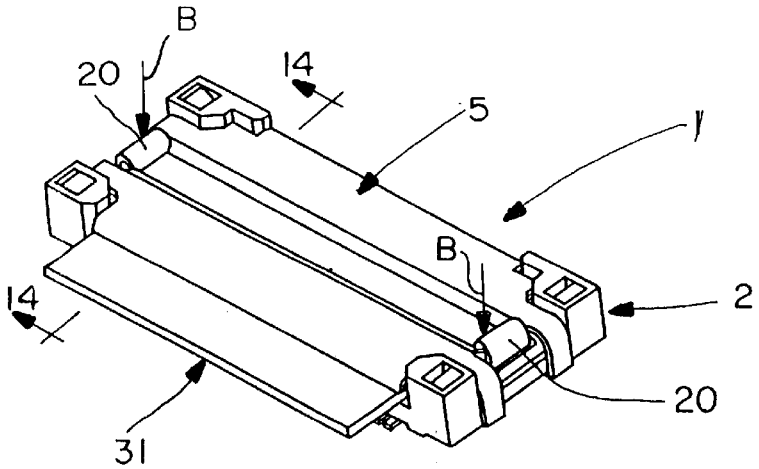
FIG. 12 is a perspective view similar to that of FIG. 11, with the cover fully mounted to the base.
Figure 13:
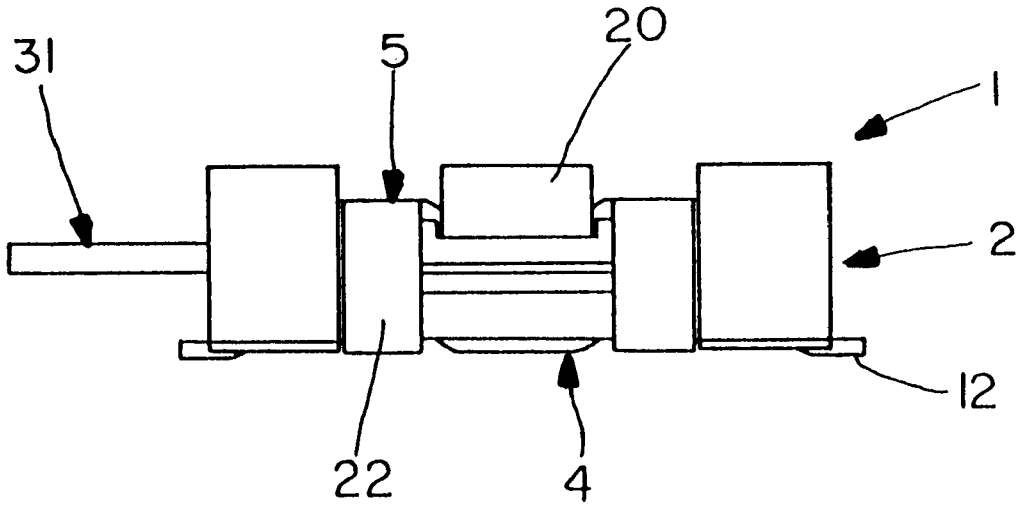
FIG. 13 is an end elevational view of one end of the connector in FIG. 12.
Figure 14:
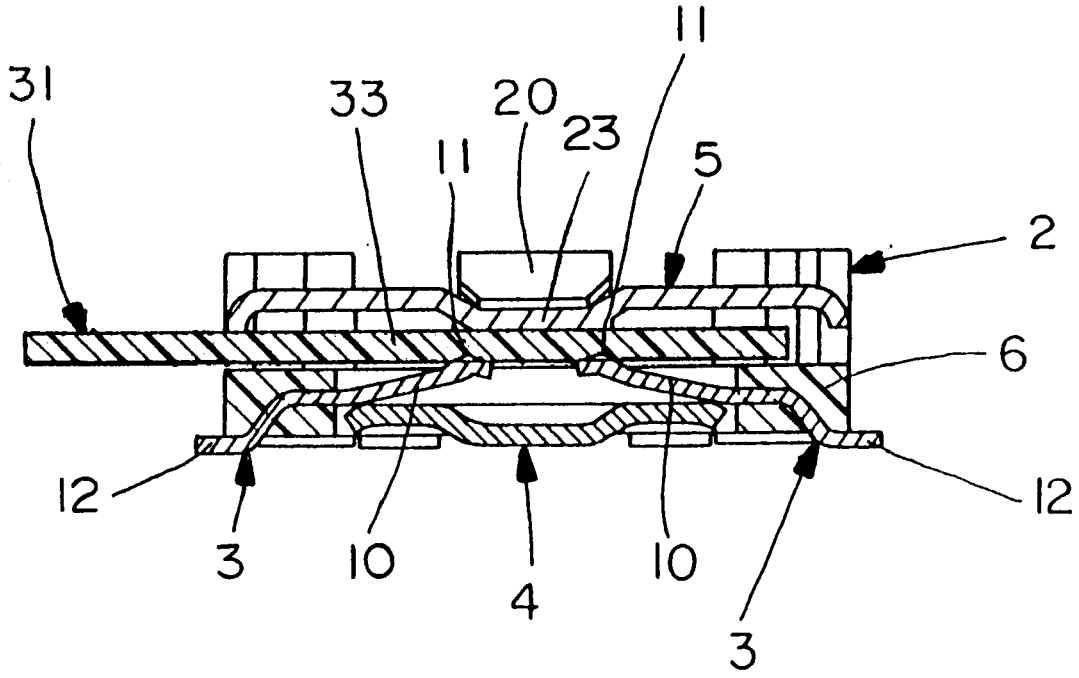
FIG. 14 is an enlarged vertical section taken generally along line 14—14 of FIG. 12.

FIGS. 11–14 show a second embodiment of electrical connector 1 according to the invention. In this second embodiment, dielectric base 2, terminals 3 and support member 4 are substantially identical to the first embodiment, and a detailed description thereof will not be repeated. In addition, like reference numerals have been applied in FIGS. 11–14 corresponding to like components described above in relation to the first embodiment of FIGS. 1–10. The difference between the two embodiments resides in cover 5 being held onto dielectric base 2 by hooks 20 of support member 4. More particularly, FIG. 11 shows the cover in a relatively raised position corresponding to the final position of the cover in the first embodiment shown in FIG. 1. However, FIG. 12 shows the cover having been moved further downwardly in the direction of arrows "B" to a clamping position beneath hooks 20 of the support member. This clamping position is afforded because, as seen in FIG. 14, end portion 33 of flat circuit 31 is not thickened by a back plate as seen in comparing FIG. 14 with FIG. 10. Therefore, as seen in FIG. 14, the cover is pressed downwardly so that central portion 23 snaps beneath hooks 20 of support member 4. The central portion, thereby, engages the top of end portion 33 of flat circuit 31 and biases the conductors on the underside of the circuit against contact ends 11 of resilient contact portions 10 of terminals 3. In comparing FIGS. 14 and 10, it can be readily be seen that the circuit in the second embodiment (FIG. 14) is sandwiched between the cover and the terminals, whereas the circuit in the first embodiment (FIG. 10) is sandwiched between hooks 20 of the support member and the terminals with the cover simply covering the assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for receiving a flat electrical circuit, comprising:

an elongated housing means defining a slot for receiving the flat electrical circuit;

a plurality of terminals mounted on the housing means with resilient contact portions spaced along the slot; and an elongated support member mounted in the housing means for providing reinforcing support for the housing means, the support member being positioned for backing the resilient contact portions of the terminals to perform a dual function of providing reinforcing support behind the resilient contact portions and being fabricated of metal material having a dielectric coating at least in areas of engagement with the contact portions of the terminals.

2. The electrical connector of claim 1 wherein said support member includes a fixing portion exposed at the bottom of the housing means for fixing the connector on an appropriate printed circuit board.

3. The electrical connector of claim 1 wherein said support member includes at least one holding portion for holding the flat circuit in engagement with the resilient contact portions of the terminals and at least one biasing portion providing reinforcing support on bottom sides of the terminals, with said holding portion engaging a top side of the flat circuit.

4. The electrical connector of claim 1 wherein said housing means includes a cover, and said support member includes at least one holding portion for holding the cover over the flat circuit.

5. An electrical connector for receiving a flat electrical circuit, comprising:

an elongated dielectric housing portion defining at least one side of a slot for receiving the flat electrical circuit;

a plurality of terminals mounted on the housing portion with resilient contact portions spaced along the slot; and an elongated support member fabricated of metal material and mounted in the housing portion for providing reinforcing support therefor, the support member being positioned for backing the resilient contact portions of the terminals to perform a dual function of providing reinforcing support behind the resilient contact portions, the support member having a dielectric coating at least in areas of engagement with the contact portions of the terminals.

6. The electrical connector of claim 5, including a metal cover forming an opposite side of said slot.

7. The electrical connector of claim 5 wherein said support member includes a fixing portion exposed at the bottom of the housing portion for fixing the connector on an appropriate printed circuit board.

8. The electrical connector of claim 5 wherein said support member includes at least one holding portion for holding the flat circuit in engagement with the resilient contact portions of the terminals.

9. The electrical connector of claim 8 wherein said support member includes at least one biasing portion providing reinforcing support on bottom sides of the terminals, with said holding portion engaging a top side of the flat circuit.

10. The electrical connector of claim 5, including a cover for the housing portion, and said support member including at least one holding portion for holding the cover on the housing portion.

11. An electrical connector for receiving a flat electrical circuit, comprising:

an elongated dielectric housing base defining one side of a slot for receiving the flat electrical circuit;

a plurality of terminals mounted on the housing base with resilient contact portions spaced along the slot; and an elongated support member being fabricated of metal material mounted in the housing base beneath the terminals for providing reinforcing support for the dielectric housing base.

12. The electrical connector of claim 11 wherein said housing means includes a metal cover forming an opposite side of said slot.

13. The electrical connector of claim 11 wherein said support member includes a fixing portion exposed at the bottom of the housing base for fixing the connector on an appropriate printed circuit board.

14. The electrical connector of claim 11, including a cover for the housing base, and said support member including at least one holding portion for holding the cover on the housing base.

15. An electrical connector for receiving a flat electrical circuit, comprising:

an elongated housing means defining a slot for receiving the flat electrical circuit;

a plurality of terminals mounted on the housing means with resilient contact portions spaced along the slot; and an elongated support member mounted in the housing means for providing reinforcing support for the housing means, the support member being positioned for backing the resilient contact portions of the terminals to perform a dual function of providing reinforcing support behind the resilient contact portions and including at least one holding portion for holding the flat circuit in engagement with the resilient contact portions of the terminals and at least one biasing portion providing reinforcing support on bottom sides of the terminals, with said holding portion engaging a top side of the flat circuit.

16. An electrical connector for receiving a flat electrical circuit, comprising:

an elongated housing means defining a slot for receiving the flat electrical circuit;

a plurality of terminals mounted on the housing means with resilient contact portions spaced along the slot; and an elongated support member mounted in the housing means for providing reinforcing support for the housing means, the support member being positioned for backing the resilient contact portions of the terminals to perform a dual function of providing reinforcing support behind the resilient contact portions and said housing means including at least one holding portion for holding the cover over the flat circuit.

17. An electrical connector for receiving a flat electrical circuit, comprising:

an elongated dielectric housing base defining one side of a slot for receiving the flat electrical circuit;

a plurality of terminals mounted on the housing base with resilient contact portions spaced along the slot; and an elongated support member mounted in the housing base beneath the terminals for providing reinforcing support for the dielectric housing base, the support member including at least one holding portion for holding the flat circuit in engagement with the resilient contact portions of the terminals and at least one biasing portion providing reinforcing support on bottom sides of the terminals, with said holding portion engaging a top side of the flat circuit.

* * * * *